US006274827B1

(12) United States Patent
Loffler

(10) Patent No.: US 6,274,827 B1
(45) Date of Patent: Aug. 14, 2001

(54) MANUAL TIMER SWITCHING DEVICE HAVING A ROTATABLE KNOB

(76) Inventor: Martin Loffler, Hauptstrasse 24, Brigachtal D-78086 (DE)

( * ) Notice: Subject to any disclaimer, the term of this patent is extended or adjusted under 35 U.S.C. 154(b) by 0 days.

(21) Appl. No.: 09/517,447

(22) Filed: Mar. 2, 2000

Related U.S. Application Data

(63) Continuation-in-part of application No. 09/027,231, filed on Feb. 20, 1998, now abandoned.

(30) Foreign Application Priority Data

Feb. 20, 1997 (DE) ..... 297 02 936 U

(51) Int. Cl.[7] ..... H01H 43/00; G04C 23/00

(52) U.S. Cl. ..... 200/38 D; 200/38 DA; 200/38 FB

(58) Field of Search ..... 200/33 R–40, 200/336

(56) References Cited

U.S. PATENT DOCUMENTS

| | | | |
|---|---|---|---|
| 2,528,841 | 11/1950 | Morrison et al. | 200/336 X |
| 3,227,826 | 1/1966 | Beare | 200/336 X |
| 3,925,629 | 12/1975 | Albinger, Jr. | 200/38 R |
| 4,130,748 | 12/1978 | Schwer | 200/38 D |
| 4,360,739 | 11/1982 | Goldstein | 200/293 X |
| 4,558,192 | 12/1985 | Thoma | 200/38 D |
| 4,823,329 | 4/1989 | Schwer et al. | 200/38 DA X |
| 4,829,279 | 5/1989 | Kicherer et al. | 337/94 |
| 5,083,477 | 1/1992 | Geil | 74/553 |
| 5,558,796 | 9/1996 | Cho | 200/5 A |
| 5,711,415 | 1/1998 | Fukuda et al. | 200/570 |

FOREIGN PATENT DOCUMENTS

| | | | |
|---|---|---|---|
| 89 02 081 U | 6/1988 | (DE) . | |
| 89 01 269 U | 6/1989 | (DE) . | |
| 2027998 | 2/1980 | (GB) | 200/38 D |

*Primary Examiner*—J. R. Scott
(74) *Attorney, Agent, or Firm*—Foley & Lardner

(57) ABSTRACT

A manual timer switching device has a housing, a program carrier, and a manually rotatable knob. The housing contains a timer switch. The program carrier is rotatably mounted to a front side of the housing, concentric with the housing. The knob is seated coaxially with the program carrier and is rotatable relative to the program carrier to manually control the timer switch via a mechanical connection. The knob has a single ended, bar-shaped operating handle on a front face thereof. The program carrier has a central opening through which the operating handle is seated. The rotating knob can also have a radially extending surface finish or markings near its peripheral circumferential region.

12 Claims, 5 Drawing Sheets

MANUAL TIMER SWITCHING DEVICE HAVING A ROTATABLE KNOB

This is a continuation-in-part of application Ser. No. 09/027,231, filed Feb. 20, 1998 now abandoned.

BACKGROUND

In a manual timer switching device, which incorporates an electromechanical timer switch, it is desirable to change the control state manually independently of the programmer keeping the time. Also, it is desirable to have a way of manually changing the control state expediently, on the front face of the timer switching device.

DE-GM 88 02 081.9, for instance, discloses a program-controlled and a manually actuable timer switching device. The manual timer switching device has a rotating knob arranged on the front face, in one of the housing comer regions, outside its rotating program carrier, which has the programmable switch actuators. In this arrangement, the rotating knob, for manually actuating the timer switch, has a relatively small outside diameter and is not clearly placed on the front face of thereof.

DE-GM 89 01 269.0 also discloses a manually actuable timer switching device having a bolt-shaped actuating element arranged inside an arc shaped trough formed in the program carrier. The actuating element is constructed with an outside diameter that is ergonomically small and arranged relatively in tight proximity to the programmable switch actuators on the program carrier, in a fashion that is difficult to operate.

SUMMARY OF THE INVENTION

The present invention relates to a manual timer switch device having a rotatable knob that can eliminate the disadvantages of the known devices for changing control state. The manual timer switch according to the present invention can provide a relatively larger knob the front face of the timer switching device in relation to a rotatable program carrier.

According to the invention, the manual switching device has a housing, a program carrier, and a manually rotatable knob. The housing contains a timer switch. The program carrier rotatably mounted to a front face side of the housing, concentric with the housing. The manually rotatable knob is seated coaxially with the program carrier and is mechanically connected to the timer switch. The program carrier is rotatable independently of the knob and has program actuators adapted to actuate the timer switch. The manually rotatable knob has a single ended, bar-shaped operating handle on a front face thereof.

The program carrier is annular, having a central opening through which the knob is coaxially situated with the program carrier. The knob is mechanically connected to the timer switch to actuate the timer switch via a plurality of levers comprising first, second, third, and fourth levers.

The program carrier has a plurality of radially extending slots through which the program actuators are slideably movable. Each actuator is movable within the confines of one of the slot between a first position and a second position. Each of the program actuators is adapted to drive the third lever when the program actuator is in the second position as the program carrier is being rotated.

The knob is rotatable between a first position where a manual operation of the timer switch is turned OFF, a second position where time controlled operation by the program actuator is turned OFF, a third position where the program actuator is adapted to actuate the timer switch, and a fourth position where the knob manually actuates the timer switch.

BRIEF DESCRIPTION OF THE DRAWINGS

These and other features, aspects, and advantages of the present invention will become more apparent from the following description, appended claims, and accompanying exemplary embodiment shown in the drawings, which are briefly described below.

DETAILED DESCRIPTION

Figure 1:
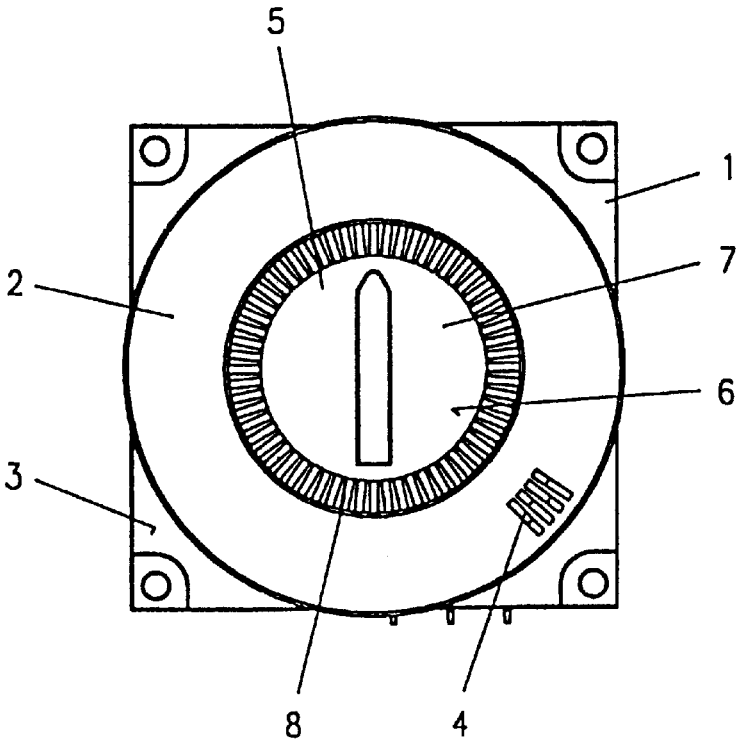
FIG. 1 shows a schematic front view of an embodiment of a timer switching device according to the invention.
Figure 2:
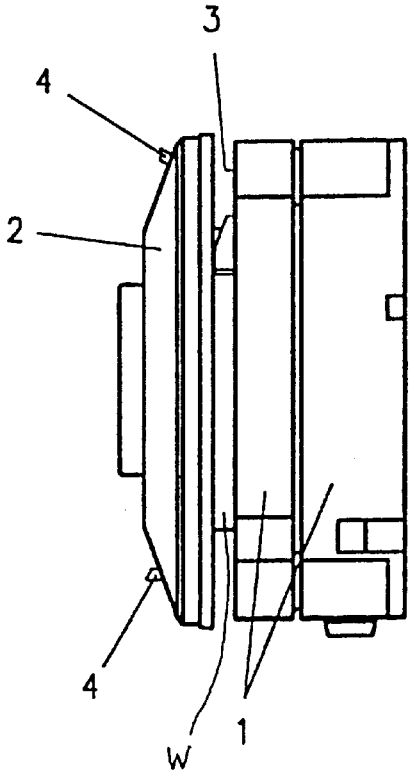
FIG. 2 shows a schematic side view of the timer switching device according to FIG. 1.

FIGS. 1 and 2 schematically illustrate an electromechanical timer switching device according to the present invention. FIGS. 3–6 show the detailed construction and operation of the timer switching device. As illustrated in FIG. 2, the timer switching device can be of a modular design. In this respect, the timer switching device has a housing 1, a program carrier 2, and a manually actuable knob 5. The housing preferably has a square cross section, as clearly seen from FIG. 1. The program carrier 2 is annular, having a central hole (not numbered) through which the knob 5 is concentrically arranged with the program carrier 2 and with the housing 1 about its front face 3. The housing 1 contains a timer switch 19 with electrical leads L.

The program carrier 2 is rotatably mounted to the housing 1. In this regard, the housing can have a cylindrical shroud (not shown) extending outwardly from the housing front face 3. The program carrier 2 can have a complementary cylindrical wall W that slides over the cylindrical shroud to form a rotatable mount. The cylindrical wall W can have gear teeth (not shown) on its outer periphery. The gear teeth can engage a gear drive train (not shown), which is housed in the housing 1, driven by a motor (not shown), which is also housed in the housing 1.

Figure 3:
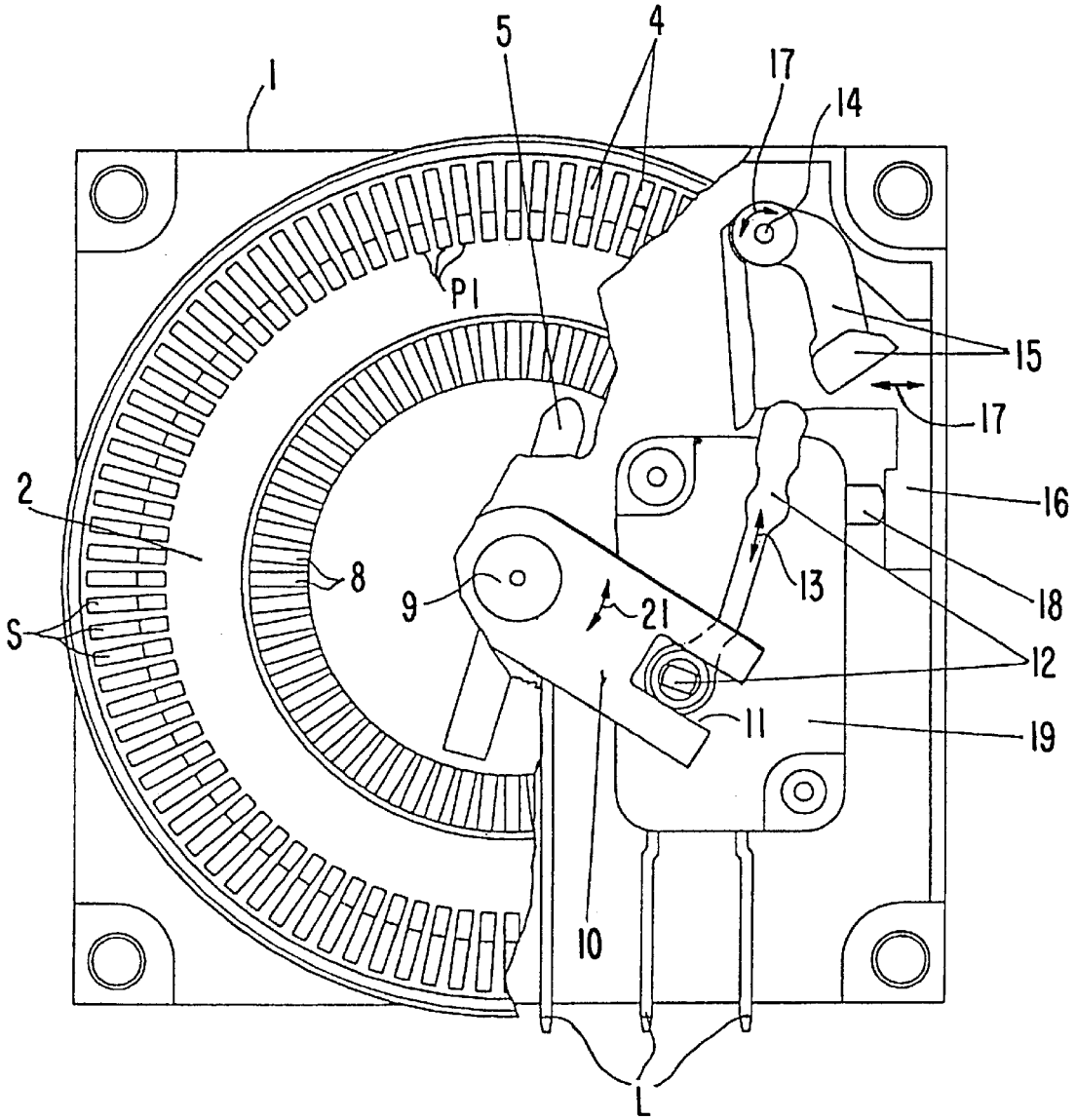
FIGS. 3–6 show partial cut-away views of the timer switching device of FIG. 1, revealing and showing different modes of the mechanical connection between the knob and the timer switch.

Programmable switch actuators 4 are arranged adjacent to the periphery of the program carrier 2. These actuators 4 can appear at a particular sector or sectors of the periphery, or as more clearly shown in FIGS. 3–6, positioned fully around the entire periphery of the program carrier 2. In the preferred embodiment, the program carrier 2 has a plurality of radially extending slots S formed equally spaced around the periphery of the program carrier 2, as shown in FIGS. 3–6. Each of the actuators 4 is slideably mounted in one of the slots S. Each actuator 4 is movable within the confines of the slot S between a first position P1 where it is nearer the center of the program carrier 2 and a second position P2 where it is further away from the center of the program than the first position, as shown in FIGS. 1 and 3.

When the actuator 4 is moved to the second position P2, as the program carrier is being driven, i.e., rotated, a portion thereof can engage and actuate a mechanism (i.e., engage a third lever 15) for actuating or triggering (i.e., pushing in a button 18 of) the timer switch 19. In the first position P1, the actuator 4 is moved away from engaging the third lever 15.

The knob 5 is coaxially received through central opening of the program carrier 2 and rotatably mounted to the housing 1 and the program carrier 2. The knob 5 can be rotatably mounted to the housing 1, for instance, using an outer cylindrical body portion (not numbered) that is secured to the housing 1 and situated coaxially in the central opening of the annular program carrier 2. The knob 5 is rotatably journaled coaxially to the non-movable outer cylindrical body portion. The knob 5 can change the control state of the timer independently of the actuators 4 programmed in the program carrier 2. In this respect, the knob 5 can rotate and position at a plurality of different positions relative to the program carrier 2.

To assist manual rotation, the knob 5 has a single-ended, bar-shaped operating lever or handle 7 extending outwardly from its front face 6. Radially extending indicia 8, such as formed by protrusions, channels, or markings, can be arranged on the outer circumferential region adjacent to the knob 5 or on the front face 6 of the knob. The front face 6 can also have other configurations or designs of the handle 7 or the indicia 8, or both.

The knob 5 is mechanically coupled to a timer switch 19 provided inside the housing to manually control the timer switch. Referring to FIGS. 3–6, the knob is connected, via a shaft 9, to a first lever 10, which is rotatable with the knob 5. The first lever 10 is mounted so that it can pivot, swing back and forth, in the direction of arrows 21 based on the rotation of the knob 5. The first lever 10 is connected to a second lever 12, which is movably mounted between the second lever and a third lever 15. The first lever 10 has a slot 11 that receives an end portion of the second lever 12. The second lever 12 is configured to move back and forth in the direction of arrows 13. The other end of the second lever 12 is engaged with the third lever 15, which is pivotally journaled to the housing 1 about a pivot 14. The third lever 15 is coupled to a fourth lever 16, which is pivotally mounted to the housing 1 also about the same pivot 14. The third lever 15, with the second lever 12, can actuate the fourth lever 16, i.e., pivot in the clockwise direction of arrows 17, to push in a switch button 18 of the timer switch 19.

In operation, FIG. 3 shows the knob 5 in a first position, where it is rotated to its most clockwise position, turning OFF the manual operation of the timer switch 19. In this position, the first lever 10 is positioned to move the second lever 12 away and out of the third lever 15. Because the second lever 12 is moved out of the pathway of the third lever 15, the third lever 15 cannot actuate the fourth lever 16 to push the button 18 in. Accordingly, in this position, even if the actuators 4 are programmed, i.e., moved to the second position P2, to engage and cause the third lever 15 to pivot counterclockwise as the program carrier 2 is being rotated, the program actuators 4 cannot actuate the timer switch 19.

Figure 4:
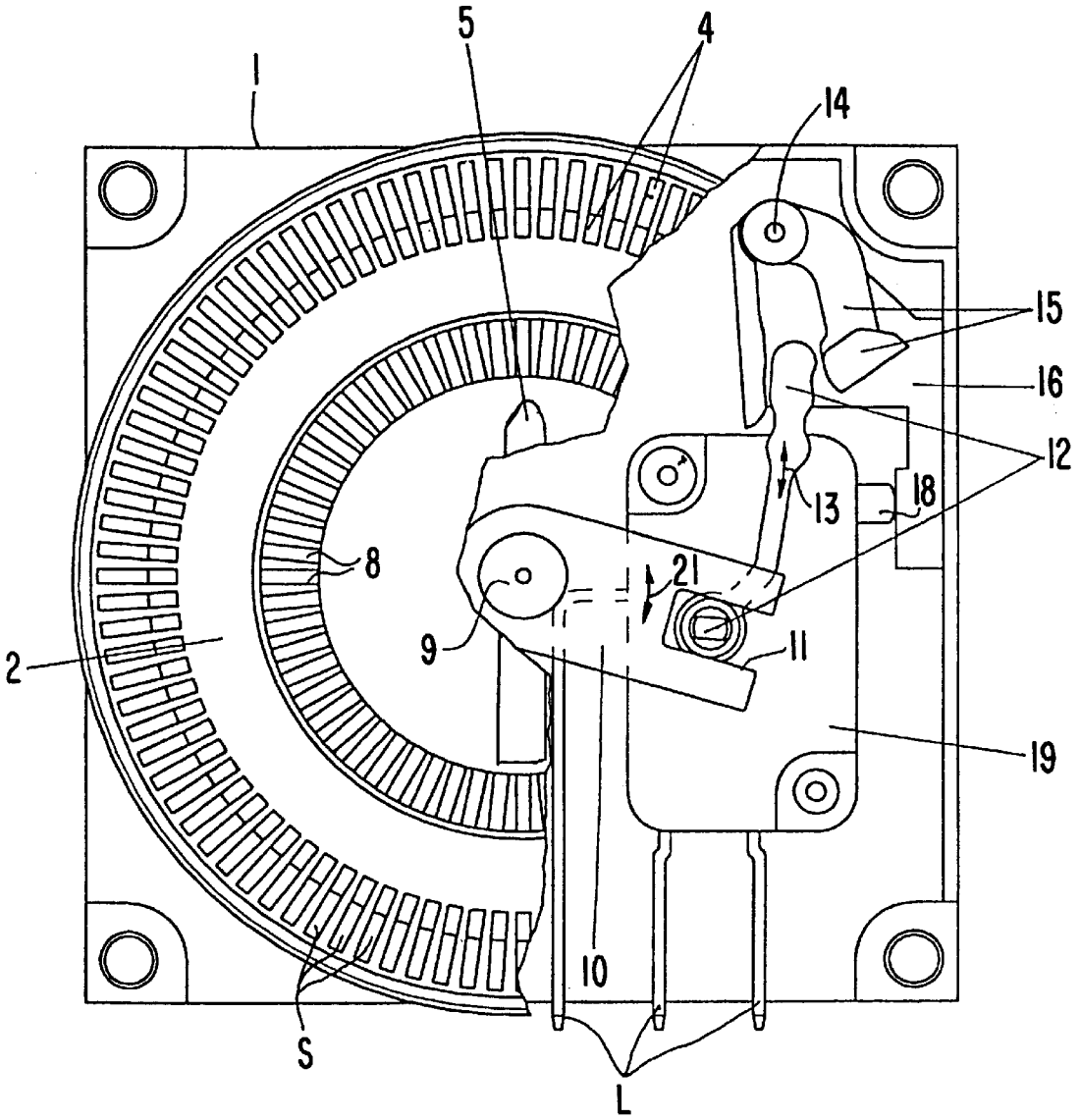

FIG. 4 shows the knob 5 in a second position, where it is turned counterclockwise from the first position. Here, the first lever 10 is rotated counterclockwise from the first position to move the second and third levers 12 and 15 to a position where the program actuators 4 can no longer strike the third lever 15. In this position, the time controlled operation by the actuators 4 is turned OFF.

Figure 5:
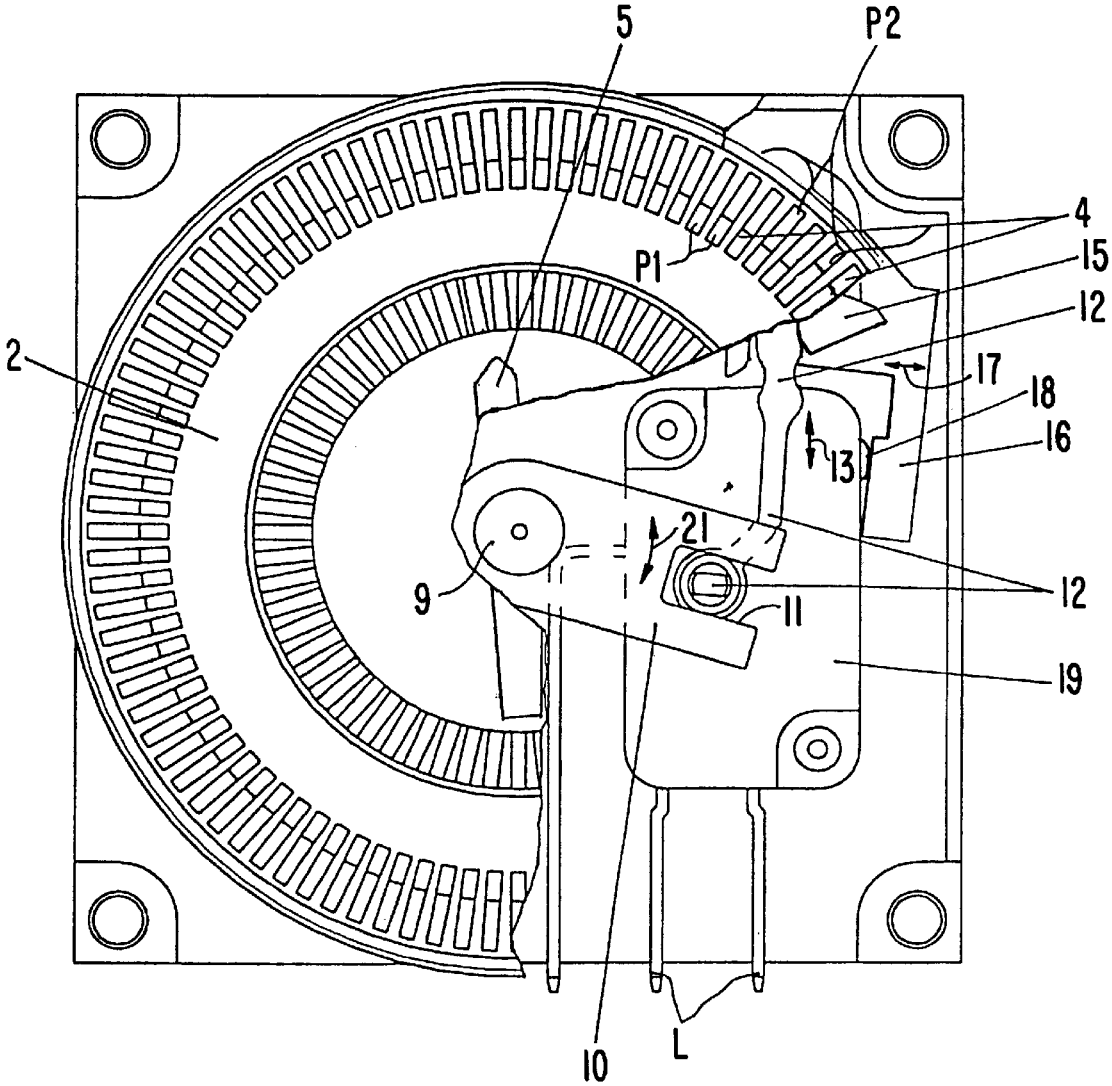

FIG. 5 shows the knob 5 in a third position, where it is turned counterclockwise from the second position. Here, the first lever 10 is rotated counterclockwise from the second position, moving the second lever 12 up and positioning the third lever 15 into a position where the actuators 4 in the second position P2 can directly strike the third levers 15 and pivot the fourth lever 16 and push in the switch button 18.

Figure 6:
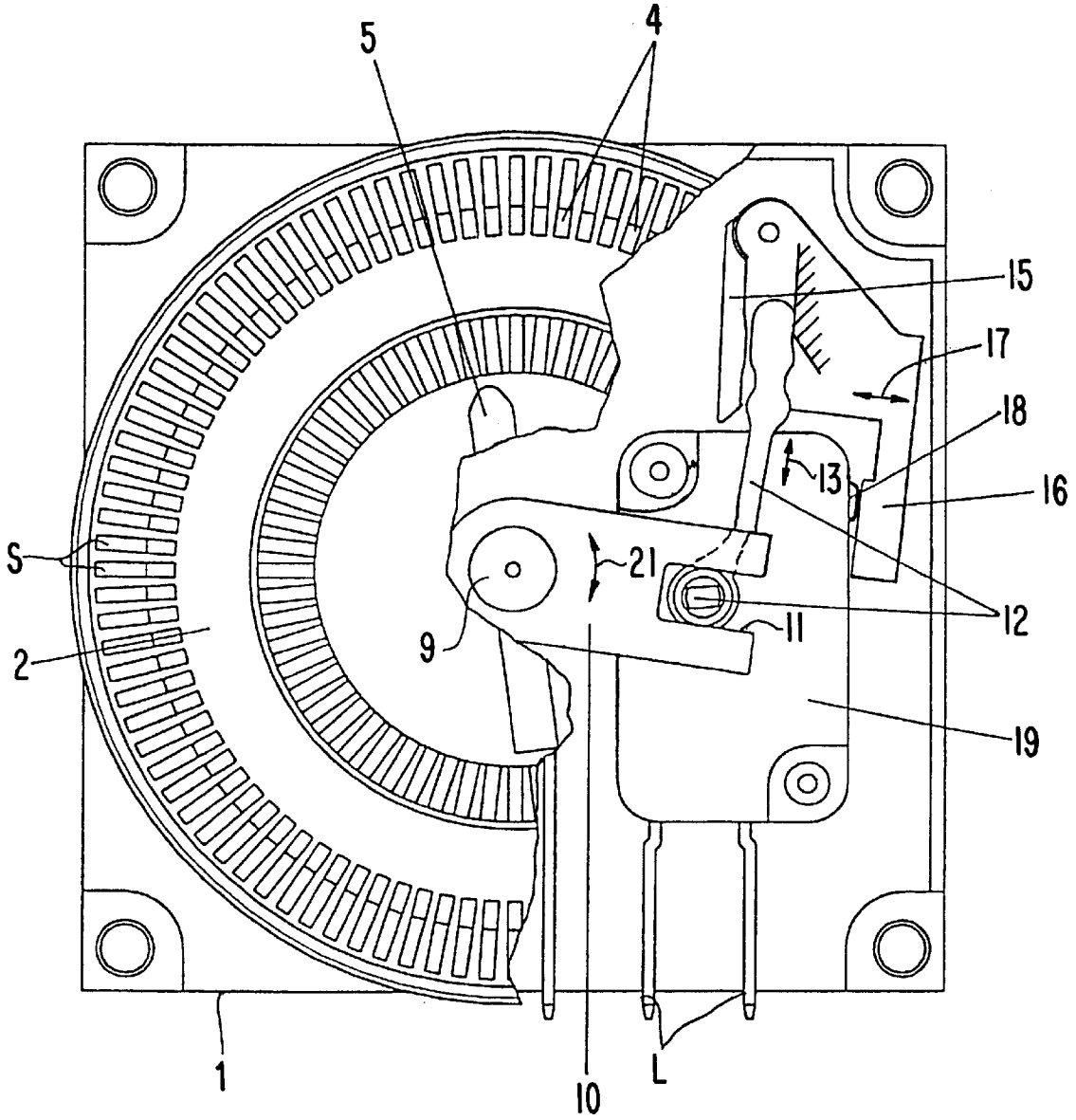

FIG. 6 shows the knob in a fourth position, where it is in the most counterclockwise position to manually push in the push button 18 using the knob. Here, the second lever 12 is pushed up so that it pivots the third lever 15 and the fourth lever 16 and push the switch push button 18 in.

The present configuration enables the knob 5 to be coaxially (and thus concentrically) arranged with the program carrier 2, which is rotatably mounted to the housing in a time-keeping fashion. This construction enables the knob to be formed ergonomically, with a relatively larger area, and one that can be operated simply with ergonomic expediency.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

The disclosure of the German priority application DE 29702.936.3 is incorporated herein by reference in its entirety, including the drawings, claims, and the specification thereof.

I claim:

1. A manual timer switching device comprising:

a housing containing a timer switch;

a program carrier rotatably mounted to a front side of the housing and concentric with the housing; and a manually rotatable knob seated coaxially with the program carrier and rotatable relative to the program carrier and the housing to manually control the timer switch via a plurality of levers, wherein the program carrier is rotatable independently of the rotatable knob and has movable program actuators engageable with the levers to actuate the timer switch as the program carrier is rotated relative to the housing.

2. A manual timer switching device according to claim 1, wherein the program carrier is annular, having a central opening through which the knob is coaxially situated with the program carrier.

3. A manual timer switching device according to claim 1, wherein the knob has a single ended, bar-shaped operating handle on a front face thereof.

4. A manual timer switching device according to claim 3, wherein the levers comprise first, second, third, and fourth levers, the first lever being connected to the knob, the fourth lever being engageable with the timer switch to actuate the timer switch, the second lever being connected to the first lever, and the second lever being engageable with the third lever, based on a position of the knob, and the third lever being connected to the fourth lever for pivoting the fourth lever, based on the position of the knob.

5. A manual timer switching device according to claim 4, wherein the third and fourth levers are pivotally mounted to the housing.

6. A manual timer switching device according to claim 5, wherein the third and fourth levers are pivotally mounted about a same axis.

7. A manual timer switching device according to claim 6, wherein the program actuators are engageable with the third lever to pivot the third lever to cause the fourth lever to actuate the timer switch as the program carrier is rotated.

8. A manual timer switching device according to claim 1, wherein the program carrier has a plurality of radially extending slots through which the program actuators are alideably movable.

9. A manual timer switching device according to claim 7, wherein the program carrier has a plurality of radially extending slots through which the program actuators are slideably movable.

10. A manual timer switching device according to claim 9, wherein each actuator is movable within the confines of one of the slots between a first position and a second position.

11. A manual timer switching device according to claim 10, wherein the program actuator drives the third lever when the program actuator is in the second position as the program carrier is rotated.

12. A manual timer switching device according to claim 4, wherein the knob is rotatable between a first position where a manual operation of the timer switch is turned OFF, a second position where time controlled operation by the program actuators is turned OFF, a third position where the program actuators actuate the timer switch, and a fourth position where the knob manually actuates the timer switch.

* * * * *